US006799404B2

(12) United States Patent
Spransy

(10) Patent No.: US 6,799,404 B2
(45) Date of Patent: Oct. 5, 2004

(54) WALL PANEL ASSEMBLY AND METHOD OF ASSEMBLY

(75) Inventor: Peter J. Spransy, Salt Lake City, UT (US)

(73) Assignee: Daw Technologies, Inc., Salt Lake City, UT (US)

( * ) Notice: Subject to any disclaimer, the term of this patent is extended or adjusted under 35 U.S.C. 154(b) by 0 days.

(21) Appl. No.: 10/077,400

(22) Filed: Feb. 14, 2002

(65) Prior Publication Data

US 2003/0150186 A1 Aug. 14, 2003

(51) Int. Cl.[7] ..... E04B 2/00

(52) U.S. Cl. ..... 52/582.1; 52/238.1; 52/241; 52/242; 52/481.2; 160/87

(58) Field of Search ..... 52/582.1–585.1, 52/238.1, 241, 242, 481.2, 239, 240, 243, 243.1, 474, 459–464; 160/87, 89, 90, 91, 98, 99, 100–126

(56) References Cited

U.S. PATENT DOCUMENTS 2,347,049 A * 4/1944 Green ..... 52/204.62
2,999,568 A * 9/1961 Ludwig et al. ..... 52/584.1
3,293,812 A * 12/1966 Hemmitt ..... 52/238.1
3,381,438 A * 5/1968 Bohnsack ..... 52/481.2
3,392,497 A * 7/1968 Cushman
3,587,199 A * 6/1971 Henry ..... 52/582.2
4,045,927 A * 9/1977 Diaz ..... 52/127.11
4,976,080 A * 12/1990 Zegel et al. ..... 52/239
5,010,702 A * 4/1991 Daw et al. ..... 52/241
5,065,559 A * 11/1991 Zegel et al. ..... 52/239
5,140,792 A * 8/1992 Daw et al. ..... 52/238.1
5,272,850 A * 12/1993 Mysliwiec et al. ..... 52/582.5
5,305,567 A * 4/1994 Wittler ..... 52/238.1
5,502,938 A * 4/1996 Backer ..... 52/281
5,603,192 A * 2/1997 Dickson ..... 52/238.1
6,016,632 A * 1/2000 McGee et al. ..... 52/241
6,119,427 A * 9/2000 Wyman et al. ..... 52/584.1
6,250,032 B1 * 6/2001 Davis et al. ..... 52/239
6,421,968 B2 * 7/2002 Degelsegger ..... 52/204.62
6,519,907 B1 * 2/2003 Weissinger ..... 52/582.2

* cited by examiner

*Primary Examiner*—Jeanette E. Chapman
(74) *Attorney, Agent, or Firm*—Traskbritt

(57) ABSTRACT

A wall assembly includes at least two panel elements which are configured for contiguous placement adjacent to one another. Each of the panel elements defines a hollow internal passageway. The panels are configured to permit a contiguous placement whereby the respective passageways of the panels are brought into registration with one another. A connection element is positioned within one of the passageways. The connection element is accessible through a slot defined within the sidewall of the panel wherein the connection element resides. The connection element is slidable whereby it may be displaced partially into the second panel element. The connection element is thereafter actuatable whereby its lateral dimension is decreased to form a pressure fit union with the interior sidewalls of the two passageways. In its spatially decreased configuration, the connection element provides a means of interconnecting the two panel elements together.

19 Claims, 9 Drawing Sheets

WALL PANEL ASSEMBLY AND METHOD OF ASSEMBLY

BACKGROUND OF THE INVENTION

1. Field

This invention relates to assemblies of panel elements and methods for their assembly. More specifically, the invention is directed to an assembly of panels which may be utilized to form a wall or other structural member together with methods of constructing same.

2. State of the Art

Various structural constructions are formed by the interconnection of various smaller structural elements. While an integral structure may present certain structural advantages, oftentimes the limitations in manufacturing and handling techniques and capabilities dictate that a structure may only be constructed by manufacturing smaller elements and thereafter associating those elements one with another to construct the large structure. Furthermore, the limitations imposed by transportation of the finished structure also in part determine the approach to be taken in constructing a large structural construction.

The construction of a wall assembly is one example wherein such constraints are evident. For example in the construction of wall assemblies for rooms designed for manufacturing computer componentry, hereinafter "clean rooms", the wall assemblies must oftentimes exceed fourteen feet in height. Conventional manufacturing equipment for fabricating the elements of such rooms, e.g. metal bending presses, is typically suited for forming structures having a maximum height or length of much smaller dimensions, e.g. twelve feet. It follows that such wall assemblies are typically constructed of a number of individual elements which are associated together to form the desired dimensioned wall assembly.

Due to the specialized use of the room, unconventional building techniques are oftentimes utilized to construct such rooms. For example, presently clean room walls are manufactured using "panel on stud", construction. This type of construction uses a considerable number of individual parts to fabricate the various connections and joints which form part of a conventional wall assembly. Due to the requirement for very low particulates within the room, all panel joints require batten closures to be positioned on both sides of the wall. The need for such closures further increases the number of wall components and hardware required for a conventional construction.

Present construction techniques create several significant problems for clean room construction and maintenance. Oftentimes, clean rooms are constructed with an open grate flooring system. During the construction phase of a clean room, small components of the clean room may inadvertently be dropped onto the floor system. This typically results in the components falling through the floor and out of reach of the installer. Not only is this very inconvenient but furthermore in some instances this can be hazardous.

Due to the potential revenue of an operating clean room, the room must be constructed to ensure minimal downtime. A principal cause for downtime is routine cleaning. Rooms having edges or other surfaces which collect particulates, such as dust, can increase the time required for cleaning operations. Batten closures are recognized as creating cleaning problems in view of their creating surfaces on which dust may collect.

In conventional clean rooms the upright walls of the room are typically formed of two or more vertically positioned panels, one atop the other. The uppermost panel is oftentimes installed first by hanging it from a preformed ceiling structure. Thereafter, equipment to be housed in the room is installed and only then is the remainder of the wall constructed around the installed equipment. It should be appreciated that in many of these installations, the wall is formed around the perimeter of the equipment with many pieces of equipment actually extending through the wall itself.

In rooms of the height mentioned, being composed of multiple panels, serious problems are created with regard to the structural integrity of the wall system itself. The interconnection of two or more panels extending over such a height oftentimes results in a wall system having a tendency to bend or otherwise deflect from a vertical orientation. Prior efforts to rectify this problem have included the placement of reinforcement batons over the various joints of adjacently positioned panels. The use of these elongate reinforcement batons has not been altogether satisfactory. First, the batons are time consuming to install in that each joint must be measured and a respective batons cut to order to meet the particular measurements of a particular joint. Secondly, the batons have oftentimes proven less than satisfactory in providing the desired degree of structural integrity to the joint. Lastly surface mounted stiffeners are often unattractive and they create shelves for particulate (dust) to collect on—a feature that is unacceptable in a clean room.

There exists a need for a wall assembly for use in clean room construction which avoids or resolves the various problems identified above. Specifically, it is envisaged that a wall assembly system with fewer loose parts, having a simplified installation procedure would provide a significant advantage in the industry. Furthermore there continues to exist a need for a means of structurally enhancing the joints between adjacently positioned panels in a wall assembly. This need is most apparent in the environment of wall assemblies designed for use in a vertically upright position.

SUMMARY OF THE INVENTION

A wall panel assembly of the instant invention, in its most fundamental construction, includes a first panel and a second panel. Each of the first and second panels defines a respective hollow passageway. The panels are constructed to permit the positioning of one panel adjacent to the other panel. In an assembled condition, the passageways of the adjacently positioned first and second panels are disposed in registration or alignment with one another. The first panel defines one or more openings therein which communicate with the passageway defined within that panel. A connection member is provided for interconnecting the two panels one to another. Prior to the attachment of the two panels together, the connection member is positioned within the passageway defined by a first panel. One or more securement elements may then be utilized to secure the connection member in position relative to the first panel. The second panel is then positioned adjacent to the first panel. During the course of positioning the second panel adjacent to the first panel, the connection member is inserted within the passageway of the second panel. In preferred constructions the connection member may be secured to the second panel. The second panel may define one or more openings therein through which a second set of securement elements may be inserted to form a securement of the second panel with the connection member. Alternatively, such a securement may be achieved by configuring the passageway in the second panel such that upon insertion of the connection member into that passageway a pressure fit union is formed.

It follows that once the two panels are positioned adjacent one to another and the connection element is positioned within the passageways of the two panels, the connection member is partially housed within the first panel and partially housed within the second panel to form a linkage or bridging element between the two panels. The connection member may be configured to be dimensionally compressible or contractable within one or both of the respective passageways to effect a pressure fit with the sidewalls of the passageways of one or both of the panels. In preferred constructions the connection member is configured to compress laterally. The creation of this pressure fit in association with the interaction of the securement elements and the connection member facilitate the connection element's releasable retention in place within the passageways of the two panels. The openings in the first panel are correlated with the openings in the second panel whereby a positioning of the connection member within the passages of the two panel members produces an alignment of the openings in both panel members with the respective openings in the connection member.

The connection member may be formed of two or more structural members. These structural members may be interrelated by their association with the securement element(s). In preferred constructions the securement elements operate to adjust the spatial disposition of one structural member relative to the other. By manipulating the securement elements, the user is able to cause the two structural members to be displaced inwardly or toward one another effectively compressing the lateral dimensions of the connection member and forming a pressure fit. By an alternative manipulation of the securement elements the two structural members of the connection member are displaced outward from one another thereby increasing the lateral dimensions of the connection member and releasing the pressure fit. The openings or passageways of the panels wherein the connection member is located may be structured in various configurations. In one construction, the lateral contraction of the two connection members may operate to form a pressure union between the connection member and the sidewalls of the passageway. In this configuration the lateral expansion produces a release of the engagement of the connection member with the passageway sidewall(s) referenced above thereby disengaging any pressure fit union which may have been formed prior to the alternative manipulation of the securement elements.

The connection member is preferably physically accessible through the openings in the panels. Irrespective of the placement of the connection member within the passageways of the two panels, the user may access the interconnecting member for means of either creating the pressure fit union or disengaging that union.

The described panel construction permits the construction of a wall segment by first hanging a ceiling header from the ceiling. The ceiling header typically defines a channel dimensioned to receive and retain the wall segment. Thereafter, a floor footing is secured to the floor in alignment with the ceiling header. Similar to the ceiling header, the floor footing defines a channel dimensioned to receive and retain the wall segment. Subsequently, the connection member is inserted into the passageway of the first wall panel. The connection member may be secured to the first panel by the insertion of securement elements through the openings in the first wall panel and the interaction of those securement elements with the connection member. In a preferred installation approach, the second wall panel is positioned adjacent to the first wall panel thereby aligning the passageway of the first wall panel with the passageway of the second wall panel. As the second wall panel is positioned adjacent to the first wall panel, the connection member is inserted into the passageway of the second wall panel. With the two wall panels disposed adjacently to one another, the user may then insert securement elements through the openings in the second wall panel and interact those securement elements with the connection member. As the securement elements are interacted with the second wall panel, that wall panel is secured to the connection member by a pressure fit union. The connection member forms a mechanical bond between the two wall panels. With the two panels secured one to another, the assembly formed by the two panels may then be raised to a vertical orientation and thereafter inserted upwardly into the channel formed in the ceiling header. Subsequently, the assembly may be lowered into the channel formed in the floor footing.

It should be understood that in this installation procedure, the connection member is preferably secured within the aligned passageways of the two wall panels. With the connection element in its desired location, the user may contract the connection element by further actuation of the connection member. As the connection element is contracted it forms a pressure fit with the sidewall of the passageways of the two panels. With the creation of the two pressure fits with the respective sidewalls of the two wall panels passageways, the connection member forms a secure interconnection between the two wall panels.

In the event that the user wishes to disassemble the wall assembly, the user first lifts the wall assembly sufficiently to disengage the assembly from the channel in the floor footing. Thereafter, the wall assembly is lowered at an inclined orientation to disengage it from the channel of the ceiling header. Subsequently, the user accesses the securement elements through the openings in the wall panels. By actuating the securement elements, the user may displace the elements of the connection member away from one another thereby expanding the lateral dimension of the connection member sufficiently to disengage the pressure fit union of the connection member and the passageway sidewalls. With the pressure fit union disengaged, the user may then detach the connection member from one of the wall panels. With the connection member removed from its association with one of the panels, that panel is now free to be removed from its positioning relative to the other panel.

DETAILED DESCRIPTION OF THE ILLUSTRATED EMBODIMENTS

Figure 1:
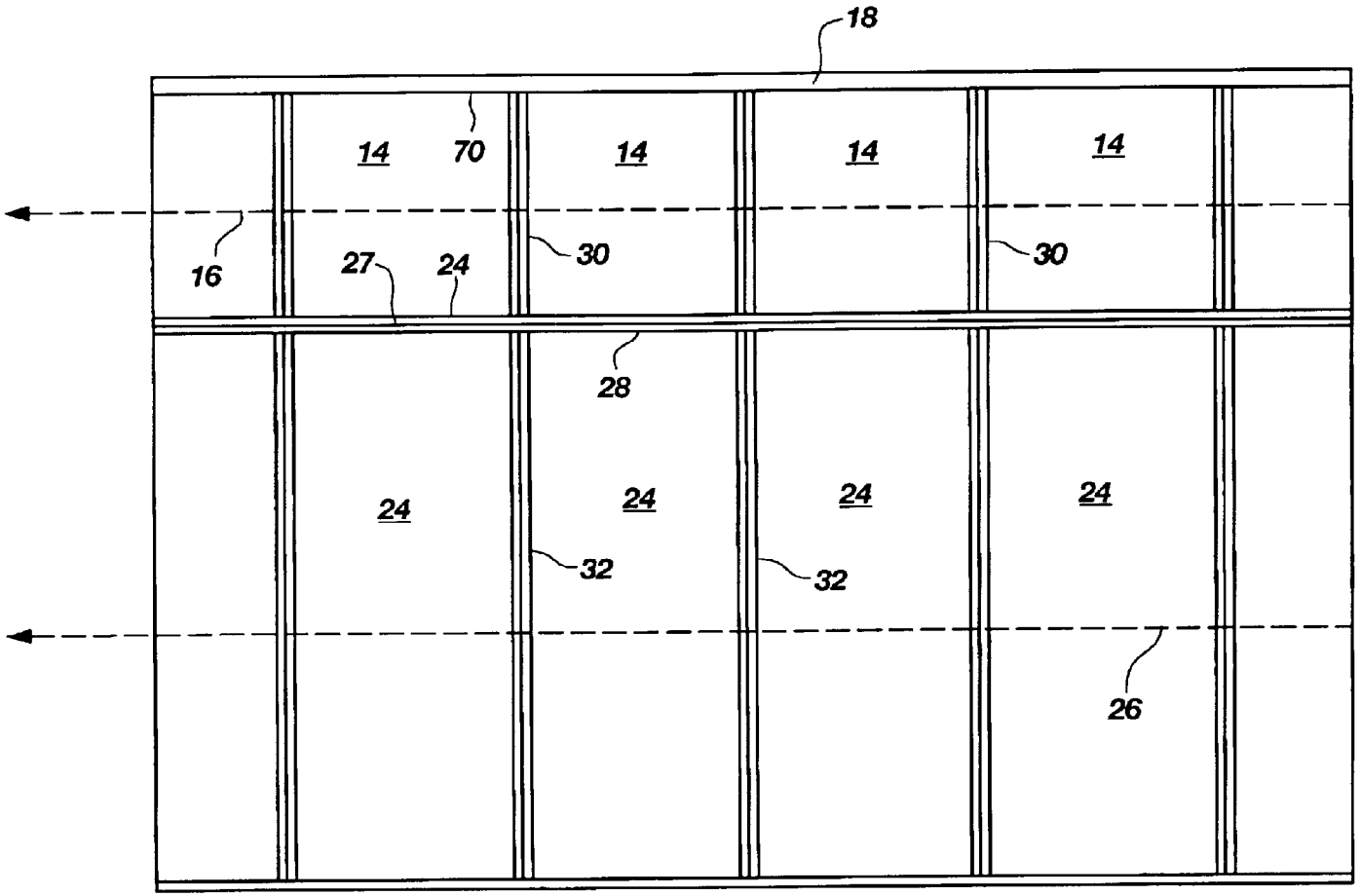
Fig. 1 (PRIOR ART)
FIG. 1 is a front view of a prior art wall construction.

As shown in FIG. 1, a clean room wall panel assembly extant in the art includes a plurality of first panels 14 which are arranged contiguously side to side along a generally linear axis 16 oriented parallel to the ceiling header 18. The uppermost side 20 of each of the first panels 14 engages with the header 18. The opposing side 22 of each first panel 14 engages with a respective second panel 24 which is positioned elevationally below its respective first panel 14. The plurality of second panels are arranged contiguously side to side to form a linear array which extends along a second linear axis 26. Each of the joints or intersections between adjacent first panels, between adjacent first panels and second panels and between adjacent second panels is reinforced by a stiff batten stud element 28. As shown to advantage in FIG. 1 first battens 28 extend to cover the intersection of all of the first panels with their respective second panels. Individual battens 30 are positioned over the intersection of each pair of adjacent first panels. Individual battens 32 are positioned over the intersection of each pair of adjacent second panels 24. It is important to note that in many instances the battens are positioned on both sides of the wall. While the use of battens provides some degree of enhanced structural integrity to these extent wall panel assemblies, the structural strength of such batten reinforced wall assemblies expectations. Furthermore, the amount of labor, time and expense created by the construction and installation of the battens has rendered this particular construction technique undesirable. Of most concern is the tendency of such battens to collect dust and other air borne debris. Given that a principal function of clean rooms is to provide a contaminant free environment, notably a dust free environment, the presence of the battens complicate the maintenance of such an environment.

Pursuant to the instant invention in FIG. 2, a ceiling header 36 is associated with a plurality of individual first panels 38 which are positioned elevationally below the ceiling header 36. In a preferred construction each of the first panels 38 are floatingly positioned within a track defined by the ceiling header 36.

Figure 9:
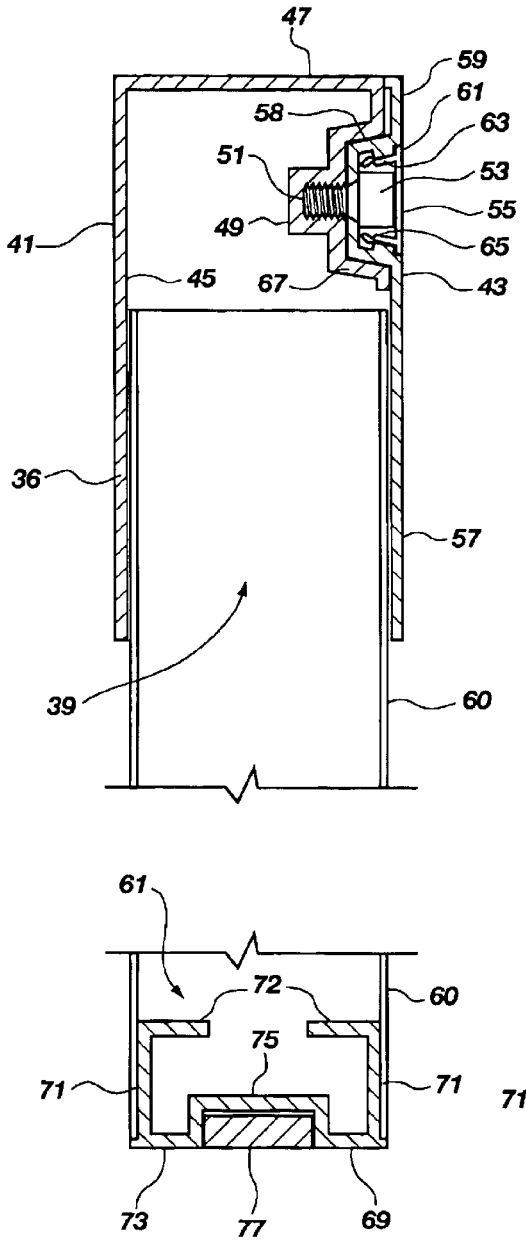
FIG. 9 is a cross sectional view of a wall panel assembly and supporting ceiling taken along section line C—C.

As shown in FIG. 9 the ceiling header 36 is formed of an elongate extrusion which defines a slot-like opening 39 in its lower edge. As shown the header 36 may be formed of a principal section 41 and a secondary section 43. The principal section defines a downwardly extending leg 45 and a laterally extending base section 47 which extends orthogonally from the leg 45. The leg 45 extends vertically downward from a proximal end of the base section 47 to form a barrier against a laterally directed displacement of a wall assembly positioned within the slot 39. The base section 47 defines a generally planar upper surface configured for placement in abutment against the ceiling of a room in which the wall assembly is to be assembled. The base section 47 may define a plurality of apertures there through dimensioned to receive fastening members, such as screws, for securing the header 36 to the ceiling.

An auxiliary section 49 of the principal section 41 extends downwardly from a distal end of the base section 47. The auxiliary section 49 defines a threaded recess well 51 which is configured to receive the threaded engagement of a bolt 53. As shown the principal section 41, the base section 47 and the auxiliary section 49 may be formed of a single integral extrusion.

The secondary section 43 of the header 36 defines a downwardly extending leg 57 and securement region 59. The leg 57 extends generally parallel to the leg 45 and in cooperation with leg 45 defines channel 39 which is dimensioned to receive and retain a wall assembly 60. The securement region 59 defines an aperture there through which is dimensioned to receive the shaft of bolt 53. As illustrated in FIG. 9, the securement region 59 of the secondary section defines a recess well 58 configured to receive the head of the bolt 53 such that in an installed condition the head of the bolt 53 is disposed to the left of the plane defined by the leg 57 and the nonrecess well portion of the securement region 59. The head of the bolt 53 may be hidden from view by a cover 61 which may be fitted with a pair of laterally extending spring loaded legs 63 which are each adapted along their length with a catch 65 configured to releasably engage with a slot 67 defined within the sidewall of the recess well 58.

A footer 69 includes a base section 73 and two upwardly extending legs 71. The legs 71 are secured to opposing ends of the base section 73 and extend upwardly generally orthogonal to the base 73 and parallel to one another. AT the upper end of each leg 71 is an extension 72 which extends inwardly from its respective leg 71. The base 73 may define a recess well 75 which is dimensioned to receive and retain an upstanding element 77 which may be independently secured to the floor of the structure wherein the wall assembly is to be installed. The recess well defines a recess specifically configured to the shape of the element 77 such that upon the insertion of the element 77 into the recess well 75, the footer is substantially held in position. The exterior sidewalls of the two legs 71 define the perimeter of the footer. The exterior sidewalls are dimensioned to be received within the hollow interior of a wall assembly 60 as shown thereby providing a stable mounting for the wall assembly. The sidewalls of the legs 71 apply a resistive force against the inner sidewalls of the wall assembly thereby substantially precluding a lateral displacement of the wall assembly.

Figure 10:
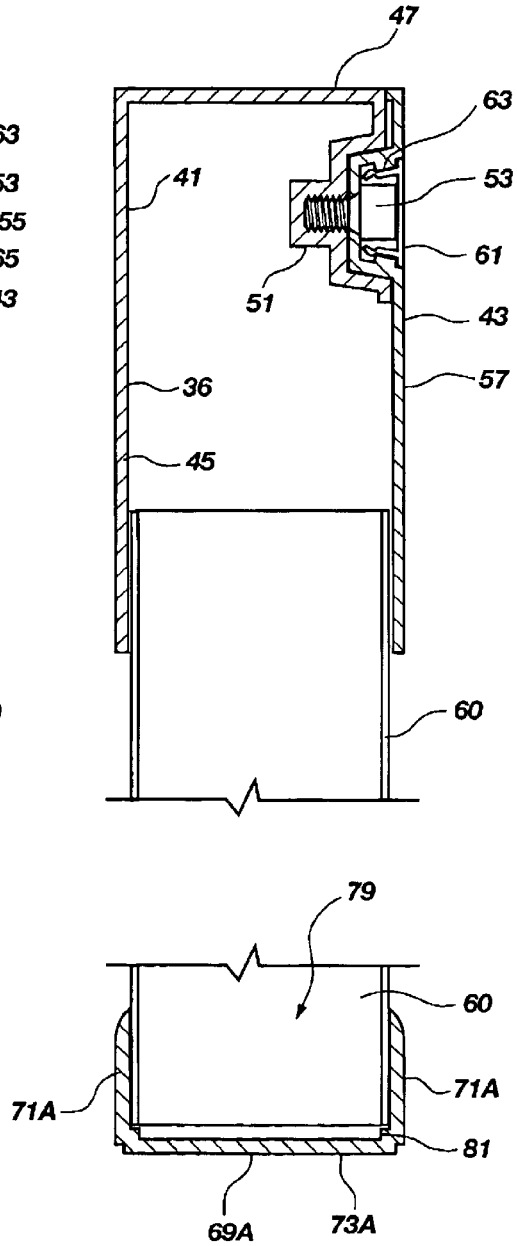
FIG. 10 is a cross sectional view of the wall panel assembly of FIG. 9 with an track.

FIG. 10 illustrates an alternative footer construction wherein the footer 69A is constructed to form a well or channel 79 dimensioned to receive the wall assembly 60 within the channel. The embodiment of FIG. 10 differs from that of FIG. 9 in that the footer 69A receives the wall assembly 60 within a channel 79 defined by the footer 69A as opposed to the embodiment of FIG. 9 wherein the wall assembly 60 defines a channel 61 into which the footer 69 is received. In the alternative footer embodiment, the base section 73A is an elongate member having a smooth bottom surface configured for placement on a planar underlying surface. Extending upwardly from each of the opposing sides of the base section 73A is an upstanding leg 71A. The legs 71A are arranged to extend generally parallel to one another to form a channel 79 dimensioned to receive and retain the wall assembly 60. In some embodiments, the base section 73A may be configured to define a secondary recess well 81 on its upper surface configured to receive and retain the lower end of the wall assembly 60. The legs 71A extend upwardly sufficiently to form a pair of barriers of sufficient size and strength to resist a lateral displacement of the wall assembly 60.

Figure 2:
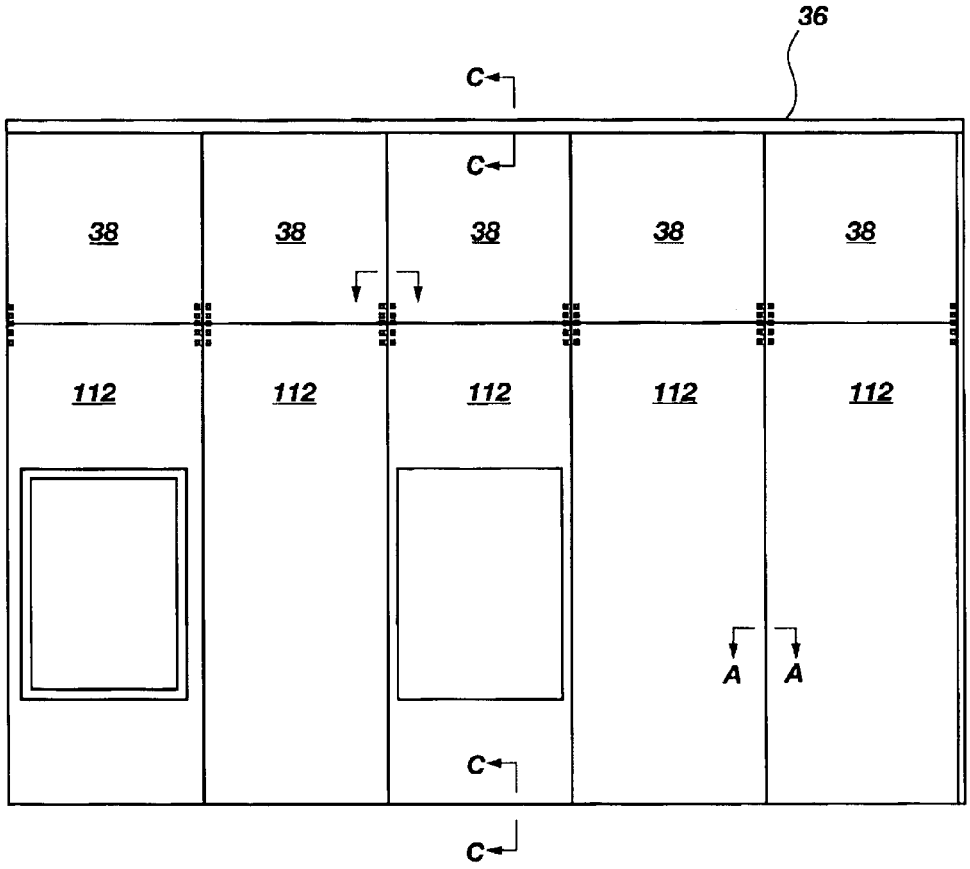
FIG. 2 is a front view of a wall panel assembly of the instant invention.
Figure 3:
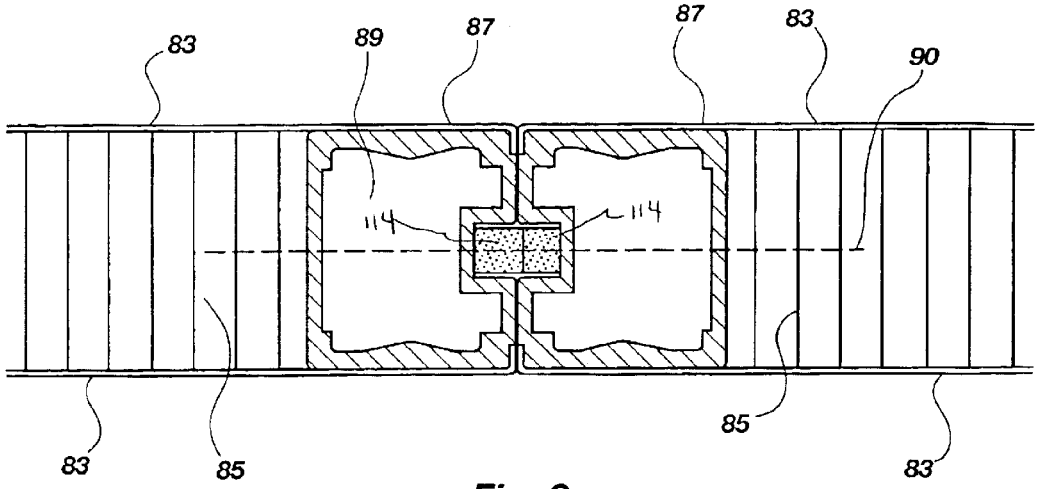
FIG. 3 is a cross sectional view of the assembly of FIG. 2 taken along section line A—A.
Figure 4:
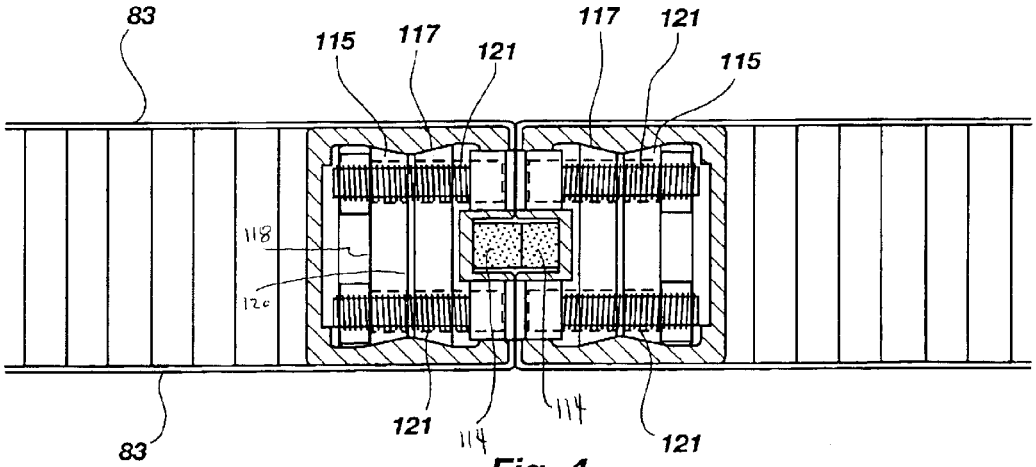
FIG. 4 is a cross sectional view of the assembly of FIG. 2 taken along section line B—B.
Figure 5:
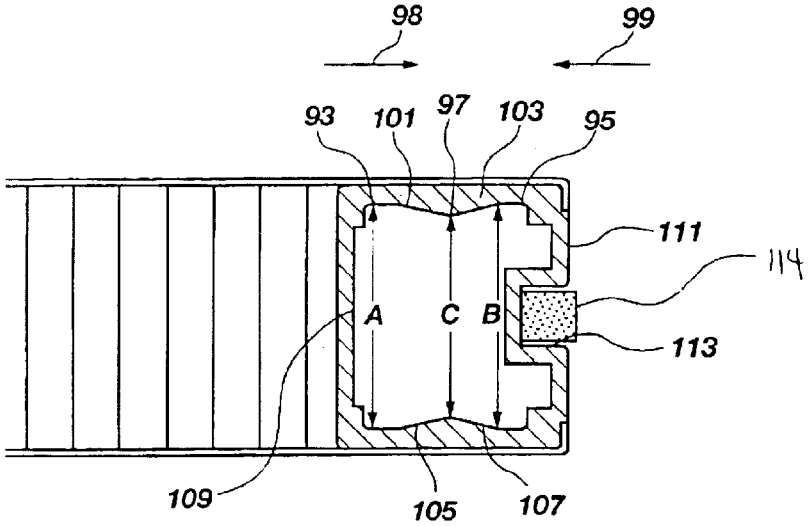
FIG. 5 is a cross sectional view of an end portion of a wall panel.

As illustrated in FIG. 2 the wall assembly of the invention includes an upper wall panel 38 superposed above a lower wall panel 112. Each of the wall panels 38 and 112 may include two planar outer panels 83 oriented parallel to one another and spacedly apart from each other. Interposed between the two panels and abutting against each panel is a core 85, which in preferred embodiments if fabricated in a honeycomb configuration. The panels are secured to the core to form a integrated assembly. Each panel includes on each of its two upright edges an extruded channel 87,which defines a hollow interior passageway 89. As shown to advantage in FIG. 3, the passageway 89 is generally symmetrical about an axis 91. Referring more particularly to FIG. 5, the channel 87 defines a passageway 89 having a plurality of angulated interior sidewalls. The passageway defines a width "A" having a first maximum width at location 93 and a second maximum width "B" at location 95. The width of the passageway dimensionally diminishes between the location 93 and the location 97 as one proceeds in the direction of arrow 98. In preferred constructions, the diminution of the width is linear. Similarly, the width decreases between the location 95 and the location 97. Again the decrease in width may be linear as one proceeds from the location 95 to the location 97 in the direction indicated by arrow 99. The passageway as a result defines a plurality of sidewalls 101, 103, 105, and 107. The width of the passageway obtains a minimum width "C" at location 97. The association of sidewalls 101 and 103 define a first sidewall. The association of the sidewalls 105 and 107 define an opposing second sidewall. A third sidewall 109 formed by a planar sidewall extends between the first and second sidewalls. A fourth sidewall 111 positioned opposite the third sidewall also extends between the first and second sidewalls. The fourth sidewall is configured to define a recess well 113 which is structured to receive and retain an insulation element 115. In preferred constructions, element 115 is a compressible element adapted to intercooperate with a counterpart element 115 of an adjacently positioned panel to form a seal between two adjacently positioned wall panels. Reference is made to FIG. 3 for purposes of illustrating an interaction of the two elements 115. The construction of the first and second sidewalls facilitates the actuation of a connection member 113 which is configured for linking each pair of panels 38 and 112 together.

Figure 6:
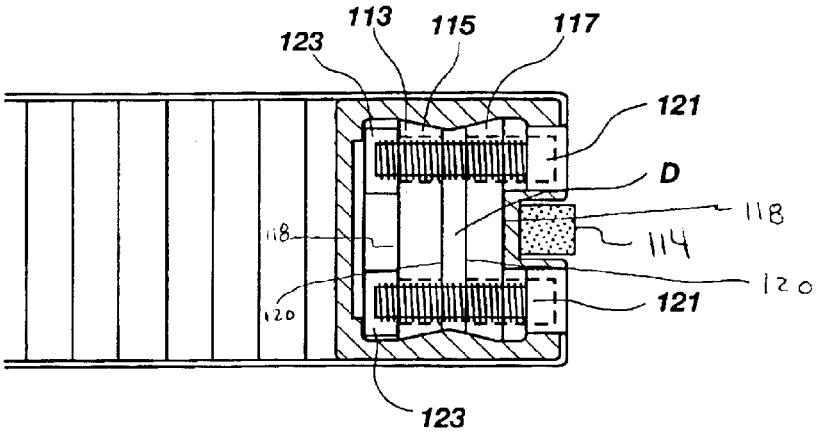
FIG. 6 is a cross sectional view of the end portion of a wall panel of FIG. 5 with a connection member, in an expanded condition, positioned within the passageway of the wall panel.

The connection member 113 may include two or more component members 115 and 117 which are positioned within the passageway 89. The component members are generally elongate structures having planar opposing surfaces 119 and 121 oriented generally parallel to one another. In each pair of opposing surfaces 116 and 118 one of the surfaces has a greater width than the other. In a preferred construction the opposing surface which faces either of the third or fourth sidewalls of the passageway has the greater width. The opposing surface of each component element which faces its counterpart component element has the dimensionally smaller width. The sides of each component member are planar in configuration and positioned in an angled relationship with the opposing surfaces. The relationship with one opposing surface defines an obtuse angle while the relationship with the other opposing surface defines an acute angle. In a preferred construction, the cross section of the component elements is generally trapizoidal in configuration. Each of the component elements defines a series of apertures 119 therein. When the component elements are positioned side by side the apertures in the two component elements my be aligned with one another whereby a securement element 121, e.g. a threaded bolt, may be extended through aligned pairs of apertures thereby interconnecting the two component elements. As shown in FIG. 6, a pair of component elements 115 and 117 are interconnected by two securement elements 121. The securement elements 121 pass through respective openings in the fourth sidewall of the channel 87. One of the component elements in each pair of such elements may be threaded 123 which is configured to threadedly receive the threaded bolt 121.

Figure 7:
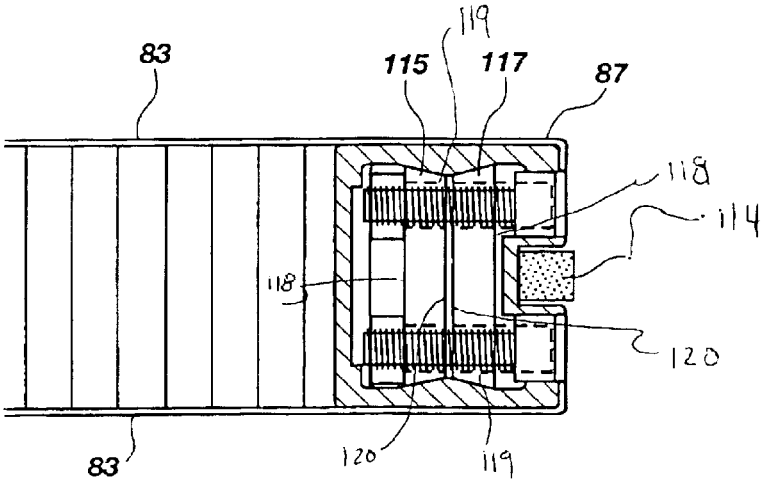
FIG. 7 is a cross sectional view of the end portion of a wall panel of FIG. 6 with the connection member shown in a contracted condition.

As shown to advantage in FIGS 6 and 7, the component elements 115 and 117 are dimensioned such that their maximum width is dimensionally less than the widths A and B. Furthermore, the irrespective minimum widths are dimensionally larger than the width C. In a first condition, shown in FIG. 6, the component elements are spatially separated from one another by a distance D by the interaction of the bolts 121. As the bolts 121 are threaded into the elements 115, the distance between the pair of elements 115 and 117 is decreased as the elements are drawn closer to one another. As the two elements approach one another, their side edge walls come into contact with the sidewalls 101, 103, 105 and 107. As the bolts 121 are further inserted into the threads of element 15 the edges of the elements 115 and 117 are wedged against the aforesaid sidewalls creating a pressure fit union against those sidewalls. With the creation of this union, the component 113 secures one panel 38 to its paired panel 112. Disengagement of this union is accomplished by reversing the direction of the bolts' rotation. As the direction of the bolt's rotation is reversed the component elements are released from their engagement against the sidewalls of the channel 87 resulting in the dissolution of the pressure fit union.

Figure 8:
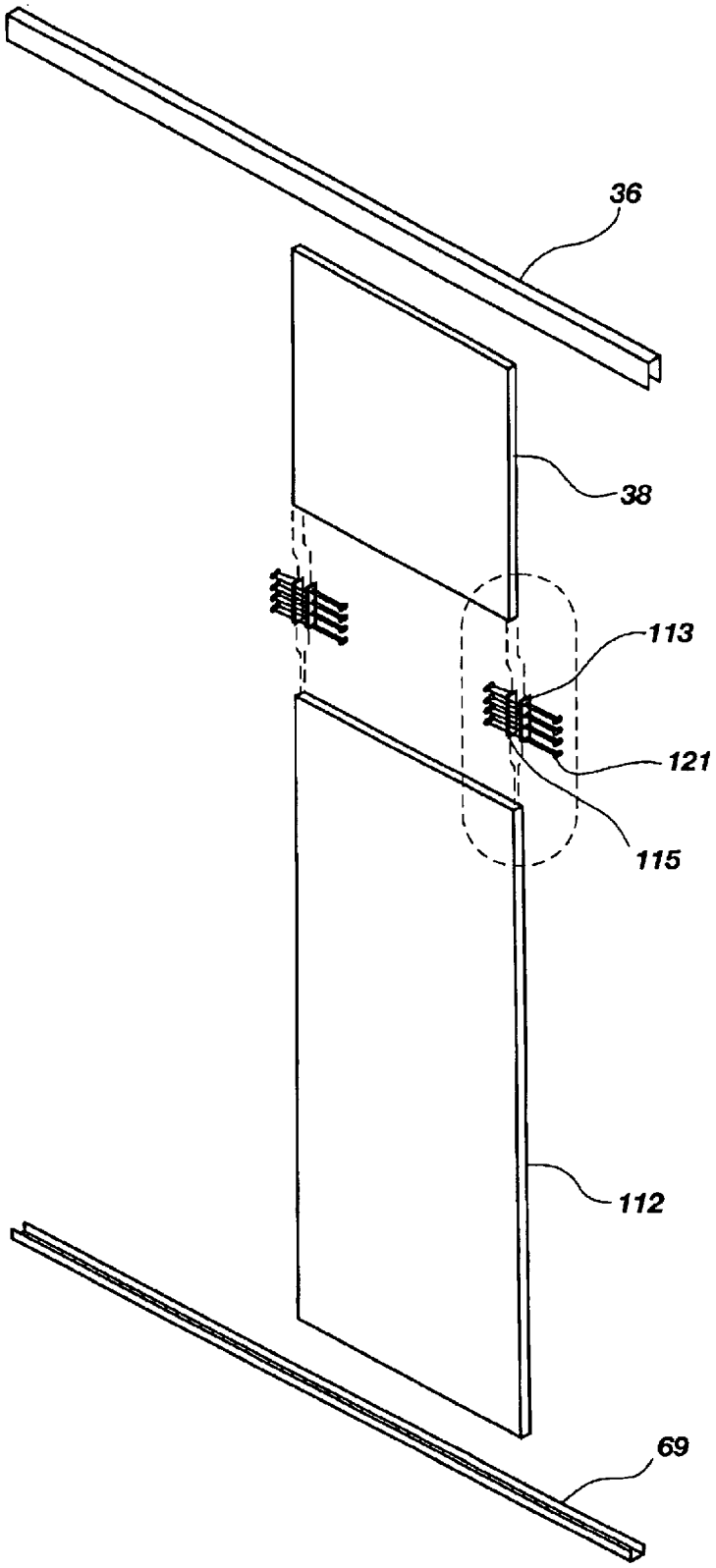
FIG. 8 is an exploded, elevational view of a wall panel assembly of the invention.

FIG. 8 illustrates in exploded view a wall panel assembly of the invention. As shown, a wall assembly formed of the panel 38 and the panel 112 is integrated by the use of two connection members 113 which are inserted in the aligned passageways of the two panels. The connection members 113 are associated with the panels by the securement elements 121. The wall assembly is inserted into the channel formed in the ceiling track 36 and subsequently inserted into the channel formed by the floor footer 69.

Figure 12:
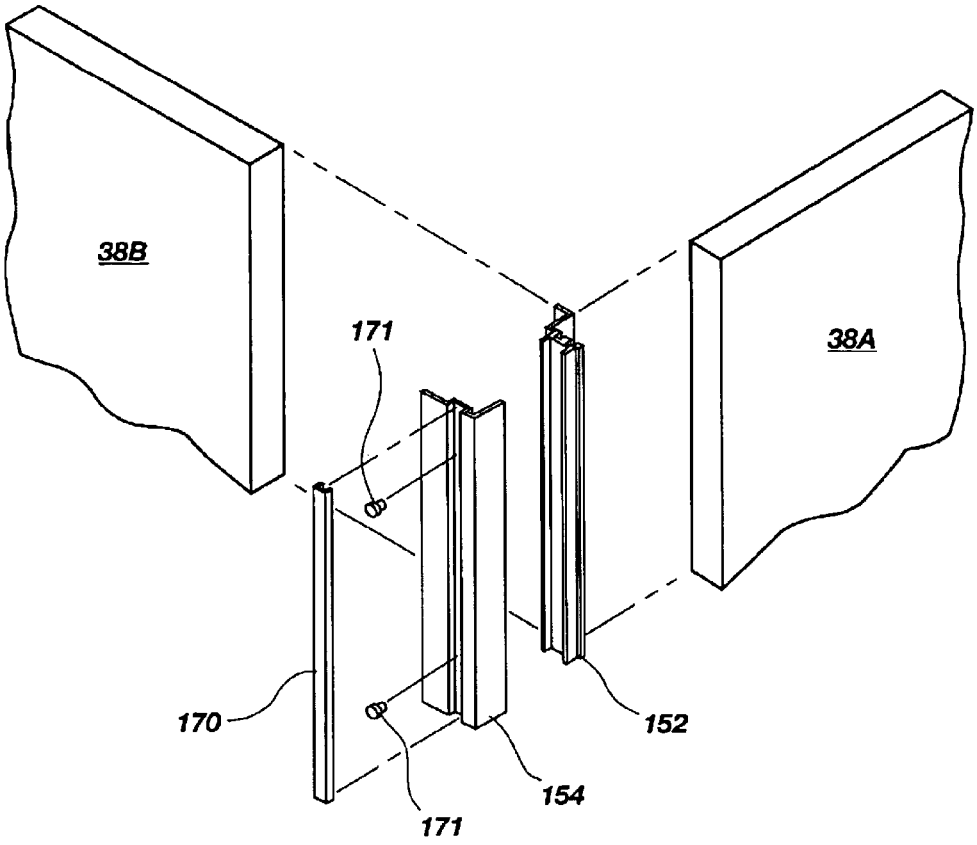
FIG. 12 is an exploded elevational view of the two wall panels of FIG. 11.
Figure 11:
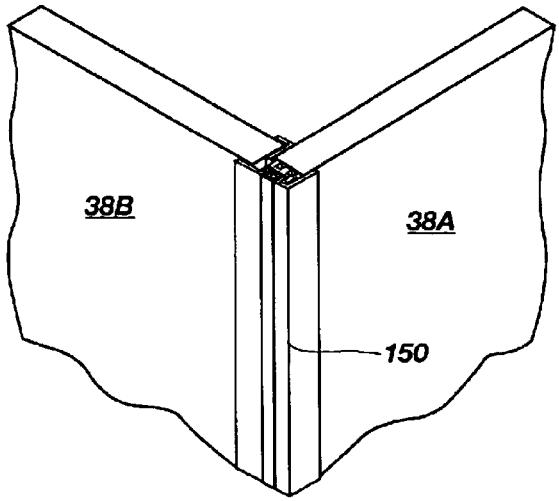
FIG. 11 is a partial sectional view of two wall panels shown in conjunction and configuration.
Figure 13:
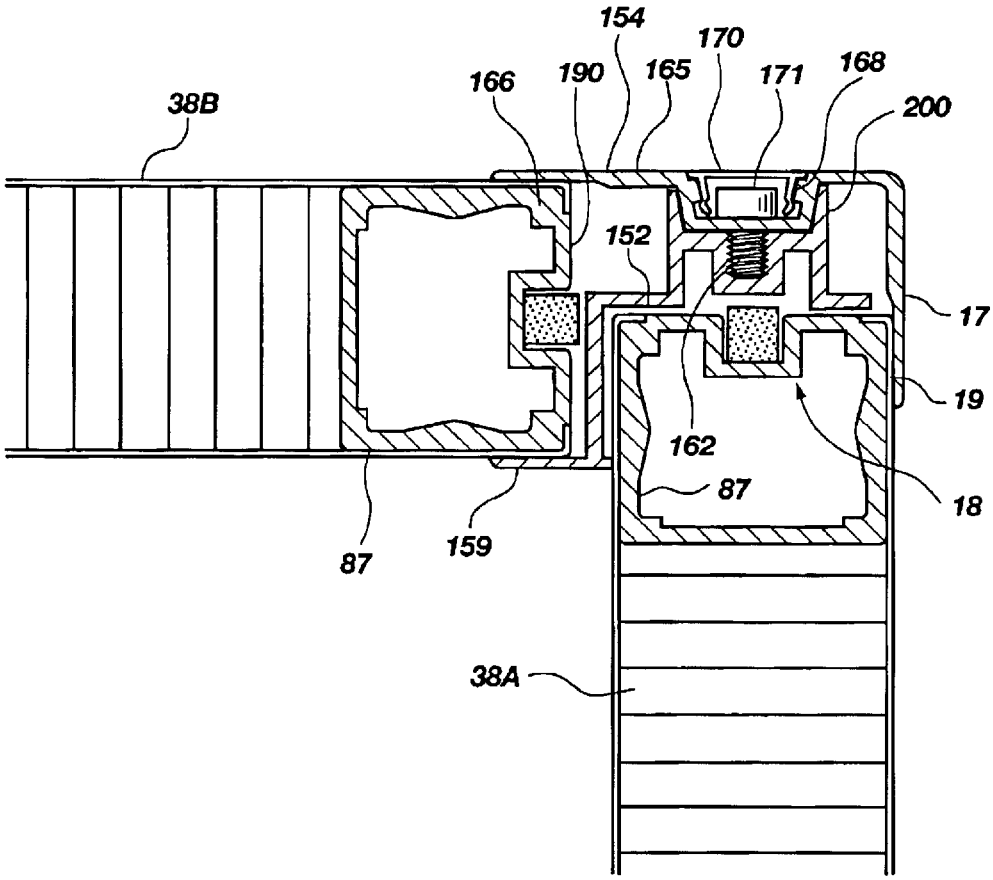
FIG. 13 is a cross sectional view of the two wall panels of FIG. 11.

FIGS 11–13 discloses a corner assembly which includes a first element 152 and a second element 154. The first element 152 is an extrusion which includes a first "L"-shaped segment 156 which is configured to extend along a portion 157 of the exterior sidewall of panel 38A as well as along a portion 159 of the exterior sidewall of panel 38B. The element 152 further includes a second segment 158 which is configured to extend along the side edge 161 of panel 38A. The second segment 158 defines a recesswell 160 the rein having a threaded well 162. Notably, the sidewall 200 of the recess well 160 is angled such that the recess well defines a smaller diameter at the entrance of the threaded well 162 than it defines at the opening of the recess well. The second clement 154 includes a main section 165 which includes a leg 164 configured to extend along a portion 166 of the exterior sidewall of the second panel 38B. The main section 165 also defines a recess well 168 which is configured to receive a securement element, e,g, a bolt 171 which passes through an opening in the main section 165 and is threadedly received in the recess well 160. The exterior sidewall of the recess well 168 is adapted to abut against the angled wall 200 of the recess well 160 thereby forming a pressure union as the bolt 171 is tightened into the threaded well 162. A cover 170 having a pair of spring loaded legs 172 may be inserted into the recess well 168 to hide the bolt from view. Similar to the legs 65 described above, the legs 172 may be configured to engage with slots 172 defined about the circumference of the recess well 160. The second element 154 also includes a further leg element 176 which extends orthogonally from the main section 165. The leg element 176 extends along a portion 178 of the first panel 38A. The leg element 176 in association with the "L"-shaped segment 156 defines a channel 180 which is dimensioned to receive and retain the side edge portion of the first panel 38A. The portion 159 of the first element 152 in association with the leg portion 164 of the main section 165 forms a channel 190 configured to receive and retain the edge of second panel 38B. As the bolt 171 is inserted into the threaded well 162, the first and second elements 152 and 154 are drawn closely together tightening the association of the legs 176 and 156 about the panel 38A and the legs 159 and 164 about second panel 38B thereby forming a union of the two elements of the corner structure 150 and as a consequence the two panels 38A and 38B.

Figure 14:
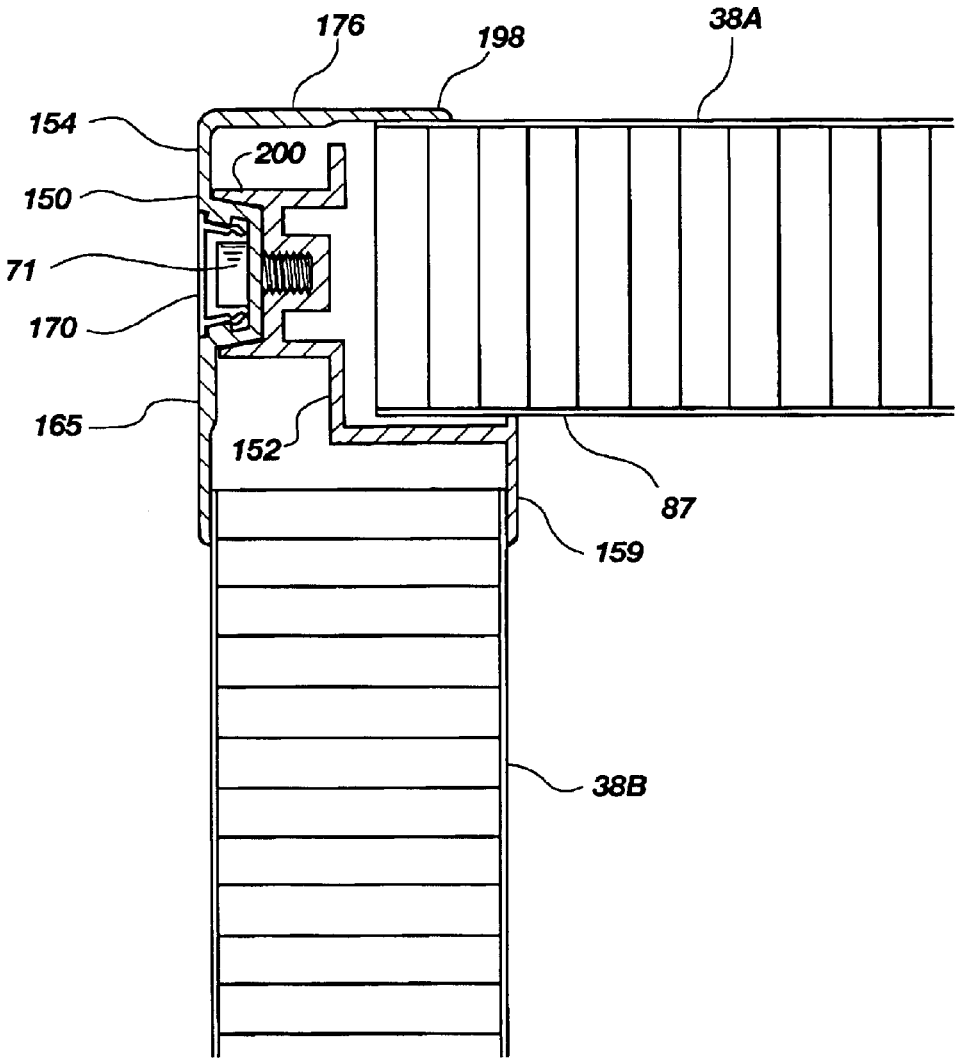
FIG. 14 is a cross sectional view of an alternative corner construction.

Should the user elect to manufacture modular wall panel elements, oftentimes the wall panels 38 will need to be cut to fit particular installations. In many such instances, the extrusion element 87 will be sacrificed during the cutting operation. FIG. 14 illustrates a corner construction utilizing the present wall panel assembly wherein a cutting operation has eliminated the extrusions 87 The instant corner assembly 150 is adapted to hold the two panels 38 in position. As shown the two panels 38 are positioned generally orthogonally to one another and are secured one to another by means of corner structure 150. The corner structure 150 is generally identical to that previous described in reference to FIG. 13. FIG. 14 illustrates an alternative corner construction wherein the extrusion elements 87 have been removed respectively from walls 38A and 38B. In this construction the first element 152 and the second element 154 are engaged with one another in a manner similar that previously described for FIG. 13. It should be appreciated that in both instances, the angulated wall 200 provides a pressure fit union of the elements 152 and 154 as the bolt 171 is threaded into the recess well 162.

The instant assembly provides a wall assembly which has sufficient stiffness that it will satisfy the UBC code section 1611.5 requirements. Given the manufacturing limitation of conventional break presses to sheet metal widths of approximately 13 feet, the instant invention provides a means of manufacturing a wall assembly of between 12 and 24 feet with sufficient stiffness to meet established code requirements. The instant wall assembly is preferably manufactured from aluminum due to its light weight and resistance to rust should it be scratched.

It is to be understood that the description of the various illustrated embodiments are merely illustrative of the various concepts of the invention. The essence of the invention is more throughly disclosed in the claims which are appended hereto.

What is claimed is:

1. A panel assembly comprising:

a first panel having a first inner sidewall defining a first passageway, said first panel defining a slot which communicates said first passageway with an environment;

a second panel having a second inner sidewall defining a second passageway and said first passageway being in alignment with said second passageway; and a connection member for interconnecting said first panel to said second panel, said connection member including a first elongate member, a second elongate member, and a first interconnection member for interconnecting said first elongate member to said second elongate member: said first interconnecting member being operative to adjust a spatial orientation of said first elongate member relative to said second elongate member;

said connection member being slidingly disposed in said first passageway and slidingly disposed partially in said second passageway, said connection member being dimensionally compressible to engage against said first sidewall and produce a pressure fit with said first sidewall;

wherein said second interconnection member is disposed within said first passageway to be physically accessible through said slot in a first condition and physically inaccessible through said slot in a second condition.

2. The panel assembly of claim 1, wherein said first panel is positioned elevationally above said second panel.

3. The panel assembly of claim 1, wherein said first passageway and said second passageway shape a common vertical axis.

4. The panel assembly of claim 1, wherein said first interconnection member is operative to adjust a lateral spacing of said first elongate member from said second elongate member.

5. The panel assembly of claim 1, wherein said first elongate member has a first longitudinal axis and said second elongate member has a second longitudinal axis wherein said first longitudinal axis is oriented parallel to said second longitudinal axis.

6. The panel assembly of claim 5, wherein said first interconnection member is operative to adjust a spacing of said first longitudinal axis relative to said second longitudinal axis.

7. The panel assembly of claim 1, further including a second interconnection member for interconnecting said first elongate member to said second elongate member.

8. The panel assembly of claim 1 wherein said second interconnection member is disposed within said first passageway to be physically accessible through said slot in a first condition and physically inaccessible through said slot in a second condition.

9. The panel assembly of claim 1, wherein said second interconnection member is positioned elevationally above said second interconnecting member.

10. The panel assembly of claim 7 wherein a length of said slot is dimensionally larger than a distance between said first interconnecting member and said second interconnection member.

11. The panel assembly of claim 1 wherein said first elongate member defines a threaded opening there through, and said second elongate member defines an abutment area wherein said first interconnecting member is a threaded bolt threadedly inserted through said threaded opening.

12. The panel assembly of claim 1 wherein said threaded opening, said abutment and said threaded bolt are disposed such that a rotation of said threaded bolt in a first direction causes a decrease in a distance separating said threaded opening and said abutment and together with a resulting decrease in a spatial distancing of said first elongate member from said second elongate member eventually resulting in a pressure fit of said first and second elongate members with said sidewall defining said first passageway.

13. The panel assembly of claim 12 wherein a rotation of said threaded bolt in a second direction causes an increase in said distance separating said threaded opening and said abutment area resulting in a release of said pressure fit.

14. The panel assembly of claim 13, wherein said spatial distancing of said first elongate member from said second elongate member is a lateral distance.

15. The panel assembly of claim 1, further comprising a plurality of first panels and a plurality of second panels, each first panel being physically associated with a respective second panel, and each said first panel being positioned adjacent another said first panel.

16. The panel assembly of claim 1, wherein each said first panel defines a first surface, said first surfaces being oriented to face in a first direction and said second surfaces being oriented to face in a second direction.

17. The panel assembly of claim 1, wherein said first passageway is gate extrusion.

18. The panel assembly of claim 1, wherein said slot in a primary said first surface of said primary first panel and a respective said slot in a secondary first panel positioned adjacent said primary first panel is defined in said second surface of said secondary first panel.

19. The panel assembly of claim 1, wherein said slot in a primary said first panel is defined in a first surface of said primary first panel and a respective said slot in a secondary first panel positioned adjacent said primary first panel is defined in said first surface of said secondary first panel.

* * * * *